United States Patent [19]

Sakamoto

[11] 4,014,553

[45] Mar. 29, 1977

[54] COMBINED GOLF BALL TETHER AND ANCHOR STRUCTURE

[76] Inventor: Minoru Sakamoto, 3911 Nioi Place, Honolulu, Hawaii 96816

[22] Filed: Nov. 24, 1975

[21] Appl. No.: 634,654

[52] U.S. Cl. ..... 273/200 R; 273/184 B

[51] Int. Cl.[2] ..... A63B 69/36

[58] Field of Search ..... 273/200 R, 184, 185, 273/198, 26 E, 196, 197 R, 197 A, 58 C

[56] References Cited

UNITED STATES PATENTS

| | | | |
|---|---|---|---|
| 3,006,647 | 10/1961 | Haskett | 273/200 R X |
| 3,143,351 | 8/1964 | Bertrand | 273/200 R |
| 3,169,771 | 2/1965 | Holmes | 273/200 R X |
| 3,663,018 | 5/1972 | O'Leary | 273/200 R X |

*Primary Examiner*—George J. Marlo
*Attorney, Agent, or Firm*—Clarence A. O'Brien; Harvey B. Jacobson

[57] ABSTRACT

An upright standard is provided including structure carried by its lower end for support of the standard from a support surface from which a golf ball may be driven. A low horizontally outwardly projecting arm is stationarily supported from the lower end portion of the standard at an elevation spaced above the lower end of the standard. An elongated flexible tether member has one end thereof anchored to the outer free end portion of the arm and a ball simulating a golf ball is anchored to the other end of the tether member. The length of the tether member is equal to at least one and one-half the effective length of the arm and the standard projects above the arm a distance equal to at least the effective length of the tether member. The arm includes relatively extendable base and free end portions with the base end portion anchored to the standard and the latter comprises upper and lower telescopingly engaged end portions removably engaged with each other.

10 Claims, 3 Drawing Figures

Fig. 1
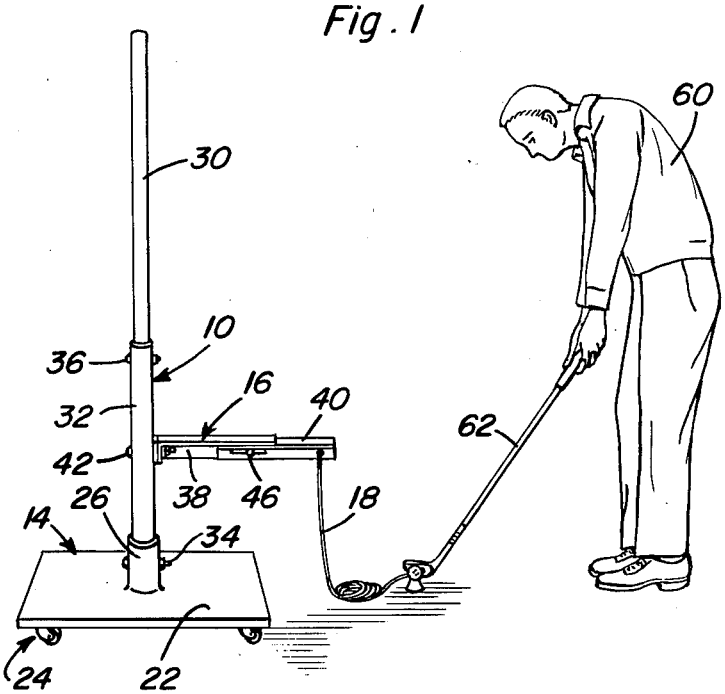
Fig. 2
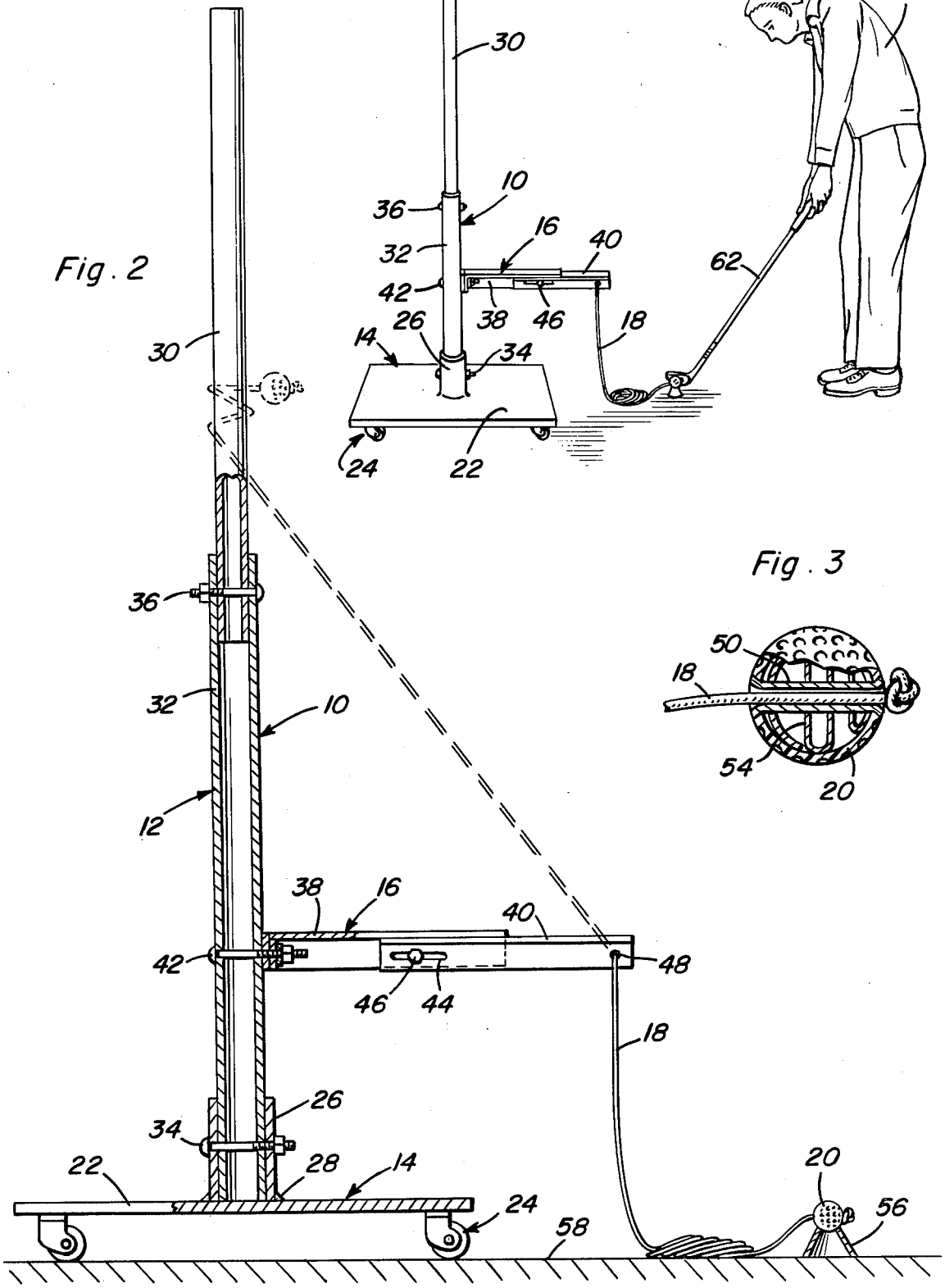
Fig. 3

COMBINED GOLF BALL TETHER AND ANCHOR STRUCTURE

BACKGROUND OF THE INVENTION

Various forms of golf practice devices have been heretofore designed for the purpose of enabling a golfer to practice his swing. Many of these golf practice devices have included tethered simulated golf balls.

However, the previously known golf practice devices utilizing a tethered golf ball with the flexible tether member therefor being adapted to be wound about an upright support to which the tether member is anchored after the ball is struck with a golf club are not constructed in a manner whereby it is substantially impossible for the user of the golf practice device to be struck by the golf ball or simulated golf ball as it orbits about the upright of the golf practice device. In addition, some forms of golf practice devices utilizing tethered golf balls do not include a tether of sufficient length to enable the user to determine the initial flight of the practice ball having been struck and other forms of golf practice devices utilizing a tethered ball do not include means whereby the initial flight of the practice ball may be gradually checked and furthermore do not include structure whereby wrapping of the tether member for the practice golf ball about the upright is limited.

BRIEF DESCRIPTION OF THE INVENTION

The golf ball tether and anchor structure of the instant invention includes structure enabling a ball which has been struck to proceed for at least a reasonable distance in its original path of flight before being deflected by the attached tether member and wound about an upright support portion of the anchor structure for the tether. In this manner, the user of the instant invention may at least estimate the flight of the golf ball struck if it was not tethered.

The golf practice device of the instant invention further is constructed in a manner whereby it may be readily disassembled and stored in a compact state and the practice device may be used by women and men of different sizes.

The main object of this invention is to provide a golf practice device of the type utilizing a tethered ball and an upright about which to wind the tether member for the golf ball after the latter has been struck.

Another object of this invention, in accordance with the immediately preceding object, is to provide a golf practice device constructed in a manner whereby the end of the tether member for the ball remote from the latter is anchored to the upright about which the tether member is to be wound at a point spaced outwardly of one side of the upright, thereby limiting the length of the tether member which may wind about the upright and also restricting the orbit of the tethered golf ball about the upright to an orbit having its center spaced appreciably horizontally from the point at which the golf ball was struck.

Another very important object of this invention is to provide a golf practice device in accordance with the preceding object, and constructed in a manner whereby the golf ball struck during a practice swing will experience a short initial flight substantially the same as that which would be experienced by a non-tethered golf ball.

A final object of this invention to be specifically enumerated herein is to provide a golf practice device in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the combined golf ball tether and anchor structure of the instant invention;

FIG. 2 is an enlarged side elevational view of the instant invention with portions of the standard, base and support arm structure therefor being broken away and illustrated in vertical section; and FIG. 3 is an elevational view of the practice golf ball portion of the instant invention with parts thereof being broken away and illustrated in vertical section.

DESCRIPTION OF THE PREFERRED EMBODIMENT

Referring now more specifically to the drawings, the numeral 10 generally designates the combined golf ball tether and anchor structure of the instant invention. The structure 10 includes an upright standard referred to in general by the reference numeral 12, a lower base referred to in general by the reference numeral 14, a support arm projecting horizontally outwardly from a lower portion of the standard 12 and referred to in general by the reference numeral 16, an elongated flexible tension member 18 and a practice ball 20.

The base 14 comprises a rigid generally square horizontal panel 22 having four depending caster wheel assemblies 24 supported from the four corner portions thereof. The center portion of the panel or panel member 22 includes an upright sleeve 26 anchored relative to the panel member 22 as at 28 and the standard 12 includes upper and lower small and large diameter tubular members 30 and 32. The lower end of the tubular member 32 is telescoped downwardly into the sleeve or sleeve member 26 and is removably secured therein by means of a diametric fastener 34 secured through the sleeve member 26 and the lower terminal end of the tubular member 32. The fastener 34 is removable whereby the standard 12 may be separated from the base 14 and the lower end of the upper tubular member 30 is telescoped down into the upper end of the tubular member 32 and removably secured in position therein by means of a removable fastener 36 similar to the fastener 34 secured diametrically through the tubular members 30 and 32.

The arm 16 comprises base and free end sections 38 and 40 comprising angle irons and one end of the base end section 38 is secured to the tubular member 32 in spaced relation above the base 14 by means of a removable fastener 42. The free end section 40 is longitudinally slotted as at 44 and a threaded shank-type fastener 46 is secured through the base end section 38 and slidably received in the slot 44 whereby the free end section 40 may be secured in adjusted extended position relative to the base end section 38.

The tether member 18 has one end thereof secured through an aperture 48 formed in the outer end of the arm 16 and the other end of the tether member 18 is secured through a diametric sleeve 50 extending through a practice golf ball 20 having internal reinforcing 54.

In operation, the structure 10 is assembled in the manner illustrated in FIG. 2 of the drawings and the length of the arm 16 is adjusted as desired. The ball 20 may be placed upon a tee 56 disposed on the surface 58 upon which the caster wheel assemblies 24 rest and with the tee and the ball 20 supported therefrom spaced outwardly of and below the free end of the arm 16. Then, the person 60 wishing to use the structure 10 assumes his stance in the manner illustrated in FIG. 1 of the drawings on the side of the ball 20 remote from the arm 16. The user 60 may then swing his club 62 into contact with the ball 20. The ball 20 will have an initial flight as though it was not tethered until the tether member 18 becomes tensioned in a direction disposed substantially at right angles to the arm 16. Thereafter, the ball 20 will swing upwardly and around the standard 12 whereby the free end of the tether member 18 will wrap itself about the upper tubular member 32 in the manner illustrated in phantom lines in FIG. 2.

Inasmuch as the tether member 18 is initially tensioned when disposed at substantially right angles to the arm 16, the initial tensioning of the tension member 18, acting through the lever arm defined by the arm 16, will cause the entire standard and base structure to rotate at least slightly on the caster wheel assemblies 24 in a clockwise direction as viewed from above for a right-handed golfer and in a counterclockwise direction as viewed from above as a result of the ball 20 being struck by a left-handed golfer.

It will of course be appreciated that a considerable portion of the length of the tension member is used in the initial swinging movement of the tension member 18 into contact with the upper tubular member 30. Accordingly, only the free end portion of the tension member 18 is available to wrap around the standard 12 insuring that the user 60 may not be struck by the ball 20 in its initial orbit about the standard 12 even if the golfer should lose his balance and step inwardly toward the standard 12. Further, inasmuch as only the free end portion of the tension member 18 wraps itself about the standard 12 as soon as the ball 20 strikes the standard 12 it will bounce backwardly and thereafter unwrap itself from the standard 12 and fall to the surface 58 whereby the standard and base assembly may be repositioned and the ball 20 may again be placed on the tee 56.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A golf ball tether structure comprising an upright standard including first means carried by its lower end for support of said standard from a support surface from which a golf ball may be driven, a low horizontally outwardly projecting arm stationarily support from the lower end portion of said standard at an elevation spaced above said first means, said arm including an outer free end portion spaced outwardly of said standard a greater distance than the spacing of said outer free end portion above said first means, an elongated flexible tether member having one end thereof anchored to the outer free end portion of said arm, a ball anchored to the other end of said tether member, the length of said tether member being at least one and one-half the effective length of said arm and greater than the spacing of said outer free end portion of said arm above said first means, said standard projecting above said arm a distance equal to at least the effective length of said tether member.

2. The combination of claim 1 wherein said arm includes base and free end sections adjustably extendable and retractable relative to each other said base end section of said arm being anchored to said standard and said one end of said tether member being anchored to said free end section.

3. The combination of claim 1 wherein said first means comprises horizontally enlarged base member to which the lower end of said standard is anchored.

4. The combination of claim 3 wherein said base member includes a plurality of horizontally spaced depending foot means.

5. The combination of claim 4 wherein said depending foot means comprise caster wheel assemblies.

6. The combination of claim 1 wherein said standard includes upper and lower sections removably joined together.

7. The combination of claim 6 wherein said first means comprises a horizontal base member to which the lower end of said standard is anchored.

8. The combination of claim 7 wherein said lower section of said standard is removably anchored to said base member.

9. The combination of claim 8 wherein said arm includes base and free end sections adjustably extendable and retractable relative to each other, said base end section of said arm being anchored to said standard and said one end of said tether member being anchored to said free end section.

10. The combination of claim 9 wherein said base end section of said arm is removably anchored to said lower section of said standard.

* * * * *